US011585194B2

(12) United States Patent
Mousavi

(10) Patent No.: US 11,585,194 B2
(45) Date of Patent: Feb. 21, 2023

(54) APPARATUS AND METHODS FOR OPTIMIZING CONTROL OF ARTIFICIAL LIFTING SYSTEMS

(71) Applicant: SSi Lift Cda, a Division of Tundra Process Solutions Ltd., Calgary (CA)

(72) Inventor: Mehdi Mousavi, Calgary (CA)

( * ) Notice: Subject to any disclaimer, the term of this patent is extended or adjusted under 35 U.S.C. 154(b) by 294 days.

(21) Appl. No.: 16/856,860

(22) Filed: Apr. 23, 2020

(65) Prior Publication Data

US 2020/0340337 A1 Oct. 29, 2020

Related U.S. Application Data

(60) Provisional application No. 62/837,530, filed on Apr. 23, 2019.

(51) Int. Cl.

| | |
|---|---|
| ***E21B 43/12*** | (2006.01) |
| ***E21B 47/008*** | (2012.01) |
| ***F04B 49/20*** | (2006.01) |
| ***F04B 47/02*** | (2006.01) |

(52) U.S. Cl.

CPC ..... *E21B 43/126* (2013.01); *E21B 47/008* (2020.05); *F04B 47/02* (2013.01); *F04B 49/20* (2013.01); *F04B 2201/0201* (2013.01); *F04B 2201/121* (2013.01)

(58) Field of Classification Search

CPC .... E21B 43/126; E21B 47/008; E21B 47/009; F04B 47/02; F04B 49/20; F04B 2201/0201; F04B 2201/121; F04B 2201/1201; F04B 2201/1211; F04B 47/04

See application file for complete search history.

(56) References Cited

U.S. PATENT DOCUMENTS

| | | | | |
|---|---|---|---|---|
| 4,390,321 A * | 6/1983 | Langlois | E21B 47/009 417/15 |
| 8,851,860 B1 * | 10/2014 | Mail | F04B 47/02 417/47 |
| 9,745,975 B2 * | 8/2017 | Dancek | F04B 47/04 |
| 2017/0260836 A1 * | 9/2017 | Robison | F04B 49/06 |

* cited by examiner

*Primary Examiner* — Abby J Flynn
*Assistant Examiner* — Yanick A Akaragwe
(74) *Attorney, Agent, or Firm* — Parlee McLaws LLP; Kirsten Macmillan Oates

(57) ABSTRACT

A system and method for optimizing performance of an artificial lift system are provided. The optimization process can be performed automatically by a controller configured to receive optimization parameters from the user and information regarding the performance of the system. The optimization process adjusts the pumping speed of the system in response to measured rod load and a position of the downhole pump or surface pumping unit. More particularly, the optimization process can increase or decrease the pump speed of the system in response to the measured rod load at a reference position relative to a reference rod load at the reference position. The reference load and position can be selected to indicate pump inefficiencies. For example, the target reference load and position can indicate fluid pounding if the measured rod load at the reference position is greater than the reference rod load at the reference position.

16 Claims, 5 Drawing Sheets

APPARATUS AND METHODS FOR OPTIMIZING CONTROL OF ARTIFICIAL LIFTING SYSTEMS

CROSS-REFERENCE TO RELATED APPLICATIONS

This application claims the benefit of U.S. Provisional Application 62/837,530 filed Apr. 23, 2019 the entirety of which is incorporated fully herein by reference.

FIELD

Generally improved apparatus and methodologies for optimizing the control of an artificial lifting system are provided. In particular, apparatus and methodologies for controlling the operation of artificial lifting systems to dynamically adapt to fluctuating reservoir conditions in real-time are provided herein.

BACKGROUND

Artificial lifting systems for pumping downhole fluids, such as crude oil or water, from a production well to the surface have been widely used in the oil and gas industry. Known artificial lifting systems include reciprocating rod pumps, electric submersible pumps (ESPs), gas lift systems, progressive cavity pumps (PCPs), and hydraulic pumps.

By way of background, reciprocating rod pumps typically comprise a sucker rod string connected to a subsurface pump, and a driving system coupled to the sucker rod for driving the sucker rod in a reciprocating motion for pumping downhole fluids to surface. For example, traditional pumpjacks or horsehead pumps comprise a prime mover, such as an electric motor or gas engine, which drives the gears of a transmission configured to provide the desired drive ratio. The transmission drives a pair of cranks, and the cranks in turn raise and lower one end of a beam having a "horse head" on the other end thereof. A steel cable, i.e., a bridle, connects the horse head to a downhole pump via a rod string comprising a polished rod and a string of sucker rods. The reciprocating movements of the horse head at surface drive the downhole pump via the rod string, reciprocating the pump between a retracted position and an extended position to pump the downhole fluids to surface. The distance between the retracted position and the extended position is referred to as a "stroke length", and the reciprocation of the downhole pump from the retracted position to the extended position or vice versa is called a "stroke". A "stroke cycle" can refer to the reciprocation of the pump from the retracted position to the extended position and back to the retracted position. A stroke may be a downstroke, wherein the downhole downhole pump is reset from the extended position to the retracted position, or an upstroke, wherein the downhole pump is actuated uphole from the retracted position to the extended position for lifting a fluid column thereabove to the surface.

Reciprocating downhole pumps typically comprise a pump plunger connected to the rod string and situated within a tubular barrel. The pump plunger has a one-way travelling valve and the barrel has a one-way standing valve. The barrel is anchored in the wellbore and the pump plunger reciprocates within the barrel to produce wellbore fluids to surface. Specifically, beginning with the downhole pump in the retracted position, the pump plunger is pulled uphole toward the extended position by the rod string and the standing valve is opened by the negative pressure created in the pump barrel, while the travelling valve is closed. Wellbore fluids are permitted to enter the barrel via the standing valve. After the plunger reaches the top of the stroke, it begins the downstroke, wherein the standing valve is closed by the positive pressure created within the barrel and the travelling valve is opened. The fluid collected in the barrel passes through the travelling valve as the plunger progresses downhole. After reaching the bottom of its stroke, the plunger once again reciprocates upwards, the standing valve is opened, and the travelling valve is closed. The fluid accumulated above the travelling valve is then lifted by the plunger towards surface while new wellbore fluids fill the barrel. In this manner, fluids from the wellbore are lifted to surface by the downhole pump.

The operating characteristics of artificial lifting systems determine its economic efficiency, including its production capacity and operating costs. For example, rod pumps having longer pump strokes require a slower pumping speed for a given production rate, and therefore result in lower rod string stress and reduced power consumption.

Ideal pumping occurs when the inflow rate of fluid into the well is equal to the pumping rate, with the downhole pump being fully submerged in fluids for the duration of the pump stroke, thus allowing complete filling of the downhole pump during every stroke cycle. In other words, ideal pumping occurs when the fluid level in the wellbore is maintained at or above the top of the downhole pump during operation.

While stroke length and pumping speed are critical operating parameters in determining the overall efficiency of the artificial lift system, the productivity of lift systems are also impacted by the characteristics of the reservoir formation and its fluids, as well as the oft-changing wellbore conditions during production. As discussed above, nominal pumping occurs when the inflow rate of the downhole pump is equal to the pumping rate, with the downhole pump being fully submerged in fluid to allow complete filling of the downhole pump on each stroke. Such complete fillage of the pump is best achieved with a sufficiently slow pump rate to permit the pump barrel to fully fill during each upstroke. Conversely, it is desirable to lift the fluid column on the upstroke as quickly as possible in order to maximize production, and further to stroke the pump downward as quickly as possible, allowing filling of the downhole pump and production of wellbore fluids to surface at the fastest rate possible. Problems arise, however, where the reservoir is incapable of supplying production fluids at a rate that is sufficient to meet or exceed the rate at which the pump fills with fluid—a phenomenon known as "pumping-off". Pump-off conditions reduces pump efficiency and wastes energy. Further, in situations where the pump barrel has only partially filled, the pump plunger moves quickly during the portion of the downstroke where there is no fluid resistance in the barrel and then slows dramatically when it suddenly contacts the fluid on its downstroke, resulting in a hammering effect that can travel up the rod string—a phenomenon known as "pounding". Pounding is detrimental to the pump system as it causes extreme stresses on the pump and rod string, for example buckling of the rod string and lateral impact of the rod string against the wellbore casing, and can result in premature failure of components of the pumping system.

The detection and control of changing reservoir characteristics during the operating life of the well can improve the efficiency and operational lifespan of artificial lift systems. To date, the incorporation of a variety of sensors and control devices have enabled the automated monitoring of detailed well data and adjustment of pumping systems to a degree in response. However, such automated systems still require an operator's intervention to adjust the operational parameters of the pumping system. Unfortunately, although pump-off controllers are well known, typical intervention in response to the detection of pump-off conditions or fluid pounding involves shutting the pump off for a period of time, rendering the well 'shut-in' or 'idle'. The well remains 'shut-in' until wellbore conditions are such that production can commence again, i.e. when the bottomhole pressure is sufficient to raise the fluid level in the well to a level above the uppermost point of travel for the downhole pump. Shutting-in a well is undesirable as it significantly decreases the time during which the pump is producing resulting in lost revenue, increases costs, and presents the risk of portions of the well and artificial lift system freezing, which further complicates the resumption of pumping operations.

There remains a need for improved systems for optimizing the operation and control of artificial lift systems to reduce fluid pounding and pump-off while maximizing production. It is desirable that such systems automatically and dynamically adapt or adjust to fluctuating reservoir conditions, in real-time and without manual intervention by an operator, thereby ensuring that the system is operating at the fastest rate possible, without resulting in pump-off or fluid pounding on the downstroke.

SUMMARY

Figure 1:
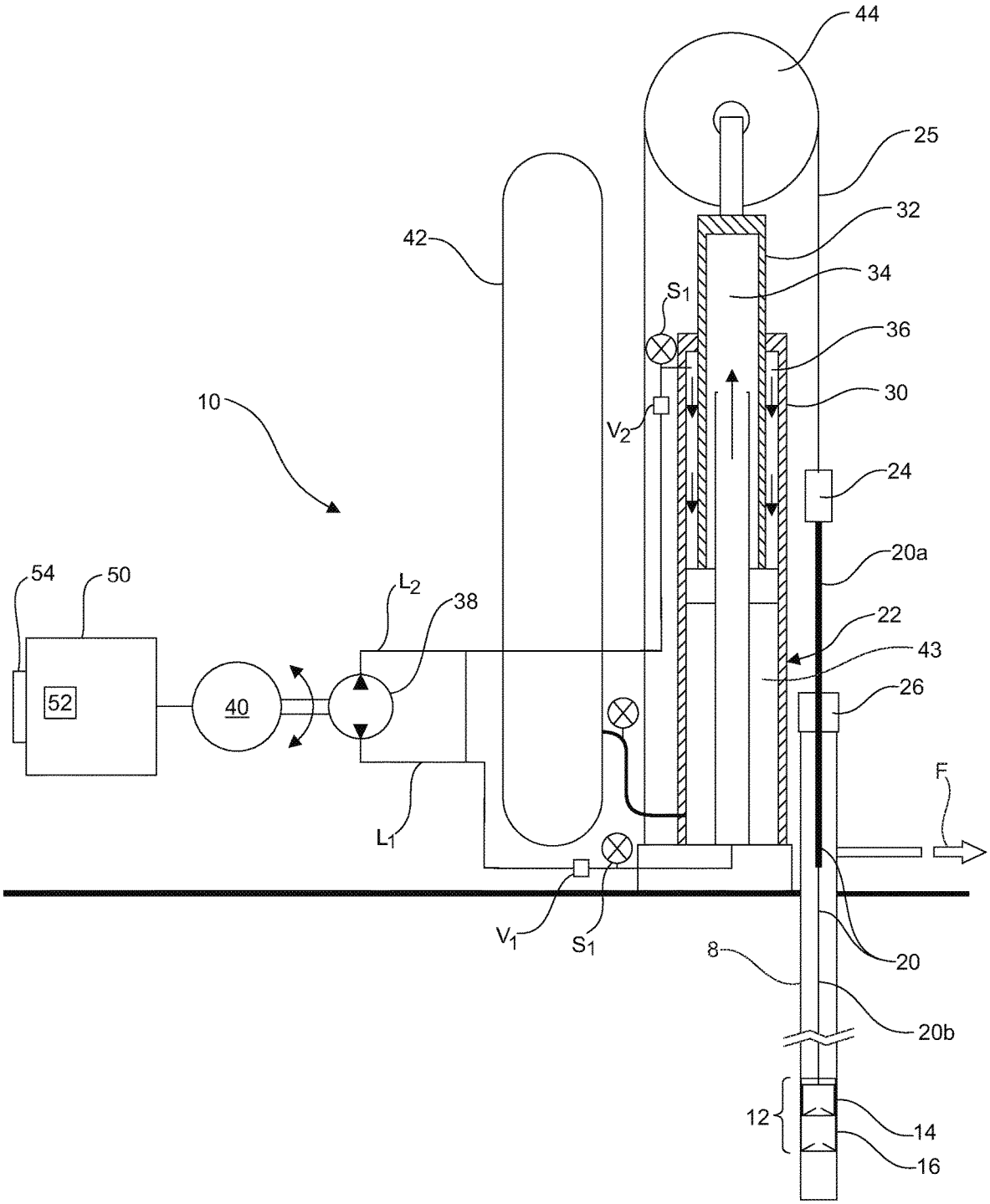
FIG. 1 illustrates an exemplary hydraulically-actuated artificial lift system, such system enabled to operate the present invention according to embodiments herein.

Generally, embodiments of a system and method for optimizing performance of an artificial lift system are provided herein. The optimization process can be performed automatically by a controller of the artificial lift system configured to receive optimization parameters from the user and information regarding the performance of the lift system as inputs. The controller can then output necessary changes to the operation of the system, if any, to maintain operation within the optimization parameters. The user-selected optimization parameters can include but are not limited to, speed rate increase and decrease increments, stabilization period i.e. the number of strokes N required to be completed between each speed rate increase or decrease, minimum/maximum pump speed rates, target reference points, and warnings/alarm notifications.

The optimization process can adjust the pumping speed of the artificial lift system in response to measured rod load and a position of the downhole pump, or the position of a hydraulic cylinder at surface configured to drive and reciprocate the pump. More particularly, the optimization process can increase or decrease the pump speed of the system in response to the measured rod load at a reference position relative to a target reference point comprising the reference rod load at the reference position. The target reference point can be selected to indicate pump inefficiencies. For example, the target reference point can indicate fluid pounding if the measured rod load at the reference position is greater than the reference rod load at the reference position. In other embodiments, the presence of pump inefficiencies can be assumed if the measured rod load is less than the reference road load. In embodiments, multiple target reference points may be used.

In embodiments, the optimization process can also be configured to only adjust the pump speed after the user-selected stabilization period has elapsed. The process can also be configured to maintain pump speed above the minimum/maximum pump speed rates.

In a broad aspect, a method of optimizing performance of an artificial lift system for producing fluid from a wellbore comprises: reciprocating a downhole pump between a lower position and an upper position with a pumping unit; measuring a position of the pumping unit and an axial load of a rod string of the lift system; comparing the measured axial load of the rod string at a first reference position with a first threshold axial load at the first reference position; and automatically adjusting a pump speed of the pumping unit according to the measured axial load at the first reference position relative to the first threshold axial load at the first reference position.

In an embodiment, adjusting the speed of the downhole pump comprises: if the measured axial load of the rod string at the first reference position is equal to or greater than the first threshold axial load, decreasing the pump speed; and if the measured axial load of the rod string at the first reference position is less than the threshold axial load, increasing the pump speed.

In an embodiment, the pumping unit is configured to decelerate from an upper deceleration point to an upper operational limit, and decelerate from a lower deceleration point to a lower operational limit, and the first reference position is between the upper and lower deceleration points.

In an embodiment, the method further comprises maintaining the pump speed if increasing the pump speed would result in the pumping unit exceeding the upper operational limit, and maintaining the pump speed if decreasing the pump speed would result in the pumping unit exceeding the lower operational limit.

In an embodiment, the method further comprises determining a first drift being the difference between the upper position and the upper operational limit, and a second drift being the lower position and the lower operational limit, and automatically controlling the operation of the pumping unit to minimize the first and second drifts.

In an embodiment, the method further comprises comparing the measured axial load of the rod string at at least a second reference position with at least a second threshold axial load at the at least second reference position, and automatically adjusting the pump speed according to the measured axial load at the at least second reference position relative to the at least second threshold axial load at the at least second reference position.

In an embodiment, the step of decreasing the pump speed further comprises decreasing the pump speed by a speed decrease interval.

In an embodiment, the decrease interval is between the range of 1% to 15% of the pump speed.

In an embodiment, the step of increasing the pump speed further comprises increasing the pump speed by a speed increase interval.

In an embodiment, the increase interval is between the range of 1% to 15% of the pump speed.

In an embodiment, the method further comprises maintaining the pump speed above a minimum pump speed and below a maximum pump speed.

In an embodiment, the method further comprises reciprocating the pumping unit at least for a transition period comprising a minimum number of stroke cycles before adjusting the pump speed.

In another broad aspect, an artificial lift system producing fluid from a wellbore to surface comprises: a linear actuator comprising a movable component moveable between a lower position and an upper position and driveably coupled to a downhole pump via a rod string; a power unit coupled to said linear actuator for driving said movable component to reciprocate; the reciprocating of the movable component driving the downhole rod pump to pump fluid to the surface; a position sensor for detecting a position of the movable component; an axial load sensor for detecting an axial load on the rod string; and a controller coupled to the position sensor, the axial load sensor, and the power unit, the controller configured to: control the power unit for reciprocating said movable component between the lower position and the upper position at a pump speed; and automatically adjust the pump speed in response to the detected position and axial load.

In an embodiment, the controller is configured to automatically adjust the pump speed to avoid fluid pounding by decreasing the pump speed if the measured axial load at a first reference position is equal to or greater than a first threshold axial load at the first reference position, and increasing the pump speed if the measured axial load at the first reference position is less than the first threshold axial load at the first reference position.

In an embodiment, the controller is further configured to decelerate the actuator from an upper deceleration point to an upper operational limit, and decelerate the actuator from a lower deceleration point to a lower operational limit, and the first reference position is between the upper and lower deceleration points.

In an embodiment, the controller is further configured to maintain the pump speed if increasing the pump speed would result in the actuator exceeding the upper operational limit, and maintain the pump speed if decreasing the pump speed would result in the actuator exceeding the lower operational limit.

In an embodiment, the controller is further configured to compare the axial load at at least a second reference position with at least a second threshold axial load at the at least second reference position, and automatically adjust the pump speed according to the measured force at the at least second reference position relative to the at least second threshold axial load at the at least second reference position.

In an embodiment, the controller is configured to adjust the pump speed by increasing the pump speed by a speed increase increment or decreasing the pump speed by a speed decrease increment.

In an embodiment, the controller is configured to maintain the pump speed above a minimum pump speed and below a maximum pump speed.

In an embodiment, the controller is configured to reciprocate the movable component for a transition period comprising a minimum number of stroke cycles before adjusting the pump speed.

DETAILED DESCRIPTION OF THE EMBODIMENTS

According to embodiments herein, improved apparatus and methodologies for controlling the operation of an artificial lift system are provided. The present apparatus and methodologies can dynamically respond to fluctuating reservoir conditions in real-time, automatically analyzing each stroke of a reciprocating downhole pump and maximizing pump fill to mitigate or eliminate pump-off conditions and fluid pounding. In some embodiments, the present apparatus and methodologies for controlling the operation of the artificial lift system may adjust the pumping speed rate based upon the actual inflow rate or filling of the pump, maximizing filling of the pump in real-time during operation. The present apparatus and methodologies will now be described having regard to FIGS. 1 to 4.

Having regard to FIG. 1, and by way of background, the presently improved apparatus and methodologies may provide improved monitoring and control of known artificial lift systems, such as those systems described in U.S. Pat. No. 8,851,860, entitled "Adaptive Control of an Oil or Gas Well Surface-Mounted Hydraulic Pumping System and Method", and in U.S. Pat. No. 9,745,975, entitled "Method for Controlling an Artificial Lifting System and An Artificial Lifting System for Employing Same", both assigned to the owner of the subject invention, and incorporated in their entirety herein.

The terms "speed rate", "pump speed", or "pump speed rate" are defined herein as a reciprocation rate or reciprocation speed of the downhole pump or surface pumping unit of the artificial lift system, for example in units of strokes per minute (SPM), and such terms are used interchangeably herein.

Referring still to FIG. 1 artificial lift systems 10 generally comprise a cylindrical downhole pump 12 submerged within a wellbore 8 at a predetermined depth so as to be submerged in wellbore fluids. Fluid and gas F can flow from the reservoir into the wellbore through perforations in the wellbore casing and into the downhole pump 12. When the pump plunger 14 is reciprocated up and down within the pump barrel 16, pump 12 lifts the wellbore fluids from the reservoir to the surface. Pumped wellbore fluids F are directed into flow lines at the ground surface for downstream processing (e.g. into separation tanks, not shown). The characteristics of the wellbore fluids F being produced may depend upon the particular reservoir, and may comprise at least oil, water, gas, or a combination thereof. Herein, the term "wellbore fluids" may be used interchangeably with terms such as "reservoir fluids", "production fluids", and/or "drilling fluids".

Having further regard to FIG. 1, rod string 20 transmits the reciprocating motion from the surface mounted pumping unit 22 to the downhole pump 12. According to embodiments, the rod string 20 may comprise an assembly of threaded steel or fiberglass rods, referred to as sucker rods, wherein the uppermost portion of the rod string 20 is a polished steel rod 20*a* that is attached at its upper end to the surface mounted pumping unit 22 through a carrier bar adapter or bridle 24. The lower part of the rod string 20*b* is attached to the downhole pump plunger 14. A stuffing box 26 seals against the reciprocating polished rod 20*a*, enabling it to reciprocate in the fluid-filled wellbore 8 without leaking fluid out of the wellhead.

According to some embodiments, during pumping operation, rod string 20 and pump 12 are reciprocated by means of the surface pumping unit 22 comprising a linear actuator such as a reciprocating hydraulic cylinder 30. In embodiments, the cylinder 30 can be a dual-acting triple chamber type cylinder, wherein a movable component such as a piston 32 is reciprocated up and down between an upper position and a lower position by the application of hydraulic flow and pressure alternatively to each side of the piston 32 via hydraulic ports formed in the cylinder 30. As would be understood, one advantage of the present system is the ability to fully monitor and control the position of the piston 32 at any point and time, enabling concurrent control of its speed and acceleration. Control of these parameters is fundamental to optimization of the pumping speed and to the productivity of the well, as will be described in further detail below. Production can thus be maximized by adapting the speed of the pumping unit 22 to reciprocate at the fastest reciprocation/pumping rate possible without pumping off the well and without experiencing pounding on its downstroke.

More specifically, with reference to FIG. 1, pumping unit 22 may comprise at least two hydraulic chambers: one chamber being an CUP' chamber 34 and another being a DOWN' chamber 36. When a hydraulic pump 38, for example a fixed displacement hydraulic pump coupled to and driven by an electric motor 40, operates in a first direction, it directs the flow of hydraulic fluid through first hydraulic fluid line L1 to the UP chamber 34, raising the piston 32 within the cylinder 30. When the hydraulic pump 38 is operated in a second direction, it directs the flow of hydraulic fluid through a second hydraulic fluid line L2 to the DOWN chamber 36, thereby lowering the piston 32 within the cylinder 30. Hydraulic flow can be gated to the UP chamber 34 and the DOWN chamber 36 by means of manually or electrically operated shut off valves V1 and V2, respectively. Hydraulic pressure can be monitored in the UP and DOWN chambers 34,36 by pressure sensors S1 and S2, respectively. Accordingly, in some embodiments, reciprocal motion of piston 32 is powered and controlled by the flow rate and direction of hydraulic fluid the from the hydraulic pump 38 to the cylinder 30, with the direction of piston 32 being determined by the direction of operation of the hydraulic pump 38. If there is no flow into either of UP chamber 34 or DOWN chamber 36, the piston 32 remains in place and the downhole pump 12 is idle.

A gas vessel 42 containing a suitable type of pressurized gas, such as nitrogen, can be coupled to a gas chamber 43 of the cylinder 30 for providing counterbalance to the weight of downhole components, such as the rod string 20, during operation of the artificial lift system 10.

A pulley 44 can be mounted on the top of the piston 32. A cable 46 can be wrapped around pulley 44, such that a first end of the cable 46 is fixed to a stationary location such as the base of the cylinder 30, and a second end of the cable 46 is attached to the polished rod 20*a* via the carrier bar adapter 24. As the piston 32 and pulley 44 move up and down, the cable 46 rolls on the pulley 44. Because one end of the cable 46 is fixed, its second end attached to the carrier bar 18 moves up and down in parallel with the reciprocating piston 32. In turn, componentry attached to the second end of the cable 46, namely the rod string 20 and the pump plunger 14, reciprocate with the stroke of the piston 32.

Various sensors, such as an axial load sensor and position sensors, can be positioned at appropriate locations of the system to monitor axial forces on the rod string 20 and the position of the piston 32 and/or pump plunger 14.

According to some embodiments, the present artificial lift system 10 may comprise a power unit 50, such as an electrical generator, configured to provide power to the motor 40 and other components of the system 10. In embodiments, a variable frequency drive (VFD) can be located between the power unit 50 and motor 40 for controlling the speed thereof, in turn controlling the speed of pump 38. A controller 52, for example a programmable logic controller (PLC), can be coupled to the power unit 50 for controlling the operation of the system 10. Further, the controller 52 can be connected to the various sensors of the system 10 to monitor the performance thereof. The controller 52 can further comprise a microprocessor, a memory, input/output interface and necessary circuitry for receiving inputs from the operator, executing machine-readable instructions stored in the memory, and providing instructions to the power unit 50. A control panel 54 can be configured to display information regarding the operation of the artificial lift system 10 and enable an operator to manually control the operating parameters thereof. The control panel 54 may comprise a touch-sensitive screen and a graphic user interface (GUI) thereon for operators to input required system parameters.

The motor 40 may comprise an electric motor operative to transfer its output torque directly to the input shaft of pump 38. The speed of the motor 40 and its direction of rotation can then be controlled by the controller 52 via the VFD by adjusting the voltage and the frequency of AC power supplied to the electric motor 40.

Pump 38 may be a fixed-displacement type pump, displacing a fixed volume of flow per turn to the cylinder 30, such that the flow rate is determined and varied by the speed of rotation of the hydraulic pump 38. In embodiments, the pump 38 may be another type of suitable pump capable of varying the flow rate to the cylinder in a controlled manner.

In operation, the controller 52 instructs the VFD to provide speed input parameters to the motor 40, such speed input parameters determining the operation of the cylinder 30 and the downhole pump 12. As will be described in more detail, instructions provided by the controller 52 are determined according to a set of control laws using optimization parameters provided by the operator and measurements collected by the various sensors of the artificial lift system 10 to achieve the desired behavior of the system 10.

The present apparatus and methodologies provide a significant improvement over the known methods of monitoring and controlling artificial lift systems. For example, U.S. Pat. No. 8,851,860 (the '860 patent) teaches a method for monitoring and controlling motion of the cylinder 30 under changing well conditions. The '860 method requires the use of a predicted model to optimize productivity of the well, such predicted model being based on specific well conditions. The method creates the predicted model using the desired production rate, the given well depth, the well inflow pressure, the well fluid type and composition, and the pumping equipment characteristics such that an "ideal model of motion" is created and used as the desired optimal motion profile for a specific well that will produce maximum flow. The '860 patent method is limited, however, as adjustment of the operation of the cylinder 30 only occurs when it is determined that the well conditions being monitored by the system differ from the specific well conditions of the predicted model. If the conditions of the well change such that the model is no longer applicable, a new model must be created in order to maintain optimized production, which may require cessation of pumping to acquire the necessary data.

Auto-Optimization Process

By way of example, FIG. 2 provides a flow chart depicting an embodiment of the present improved process 100 for operating the artificial lift system 10. In embodiments, the process 100 for auto-optimizing operation of the lift system 10 begins at step 102 by the user selecting to enable the auto-optimization mode, for example at the control panel 54. In embodiments, as shown at step 104, the auto-optimization mode may only be engaged if/when a corresponding Stroke Control Mode is also engaged.

Stroke Control Mode—As described in U.S. Pat. No. 9,745,975, incorporated herein in its entirety, the present artificial lift system 10 may also be monitored and controlled using an automatic "Stroke Control Mode" operative to ensure that the system operates within an allowable pump stroke range. For example, the controller 52 may be programmed to store a predefined top safety limit, representing a top limit that the piston rod 14 may safely extend thereto, and a predefined bottom safety limit representing a bottom limit that the piston rod 14 may be safely lowered thereto. Generally, for safety reasons, the top safety limit is lower than the physical top limit to which piston 32 can be extended, and the bottom safety limit is higher than the physical bottom limit to which piston 32 can be lowered. The top and bottom safety limits are typically determined during manufacturing of the system, and are not user-adjustable. During operation, however, the controller 52 may be programmed to operate the piston 32 between a user-selected top operational limit lower than the top safety limit, and a user-selected bottom operational limit above the bottom safely limit, resulting in a user-defined stroke length. As would be appreciated, the actual top and bottom stop positions of the piston 32 may differ than the user-defined top and bottom operational limits, causing the actual stroke length to vary (normally within a relatively small range, such variation referred to as "drift". The Stroke Control Mode may be enabled in the present process 100 to automatically detect the actual top and bottom stop positions of the piston 32, and automatically adjust the operation of the system 10 to minimize the detected drift from the user-defined top and bottom operational limits and ensure that the position of piston 32 remains within the selected range during operation. For example, when the Stroke Control Mode is enabled, the controller 52 can be configured to determine a top deceleration position, at which deceleration of the piston 32 commences during the movement thereof towards the top operational limit, and a bottom deceleration position, at which deceleration of the piston 32 commences during the movement thereof towards the bottom operational limit. The top and bottom deceleration positions can be calculated based on the detected drift to permit deceleration at the selected deceleration rate from the deceleration positions to the operational limits. Further, the controller 52 can adjust the top and bottom deceleration positions to eliminate drift between the actual top and bottom stop positions and the top and bottom operational limits, respectively, thereby fully utilizing the allowable stroke length and mitigating overshoot past the operational limits. More specifically, if the controller 52 detects that the actual top stop position is greater than the top operational limit, the controller 52 can adjust the top deceleration position to be lower, i.e. the piston 32 begins to decelerate earlier in the upstroke. Conversely, if it is detected that the actual top stop position is less than the top operational limit, the controller 52 can adjust the top deceleration position to be greater i.e. the piston 32 begins to decelerate later in the upstroke. The same logic can be applied to drift between the actual bottom stop position and the bottom operational limit.

In embodiments, the present process 100 may not be permitted to proceed without first ensuring that the Stroke Control Mode is enabled. Such automatic control of the stroke length and adjustment for drift provided by the Stroke Control Mode may be desirable as it mitigates the potential for the piston 32 to overshoot the top and bottom operational limits and reach its physical top and bottom limits, potentially damaging the cylinder 30 or piston 32, due to the changes to reciprocation speed applied by the auto-optimization process 100. For example, if the Stroke Control Mode is disabled, the system's pump-off control (POC) can automatically turn on and the present auto-optimization process 100 cannot be enabled. In embodiments, an error message can also be displayed, for example on the control panel 54, to notify the operator that the auto-optimization process 100 is not able to proceed without the Stroke Control Mode also being enabled. Conversely, if the Stroke Control Mode is enabled, the system's pump-off control (POC) can automatically be turned off and the present auto-optimization process 100 can be enabled. A review of the set speed and cycle can then be performed by the operator, for example using the control panel 54, to confirm whether the present artificial lift system 10 is operating at maximum stroke length capacity within the user-defined stroke range, i.e. within the user-defined top and bottom operational limits per the Stroke Control Mode.

Figure 2A:
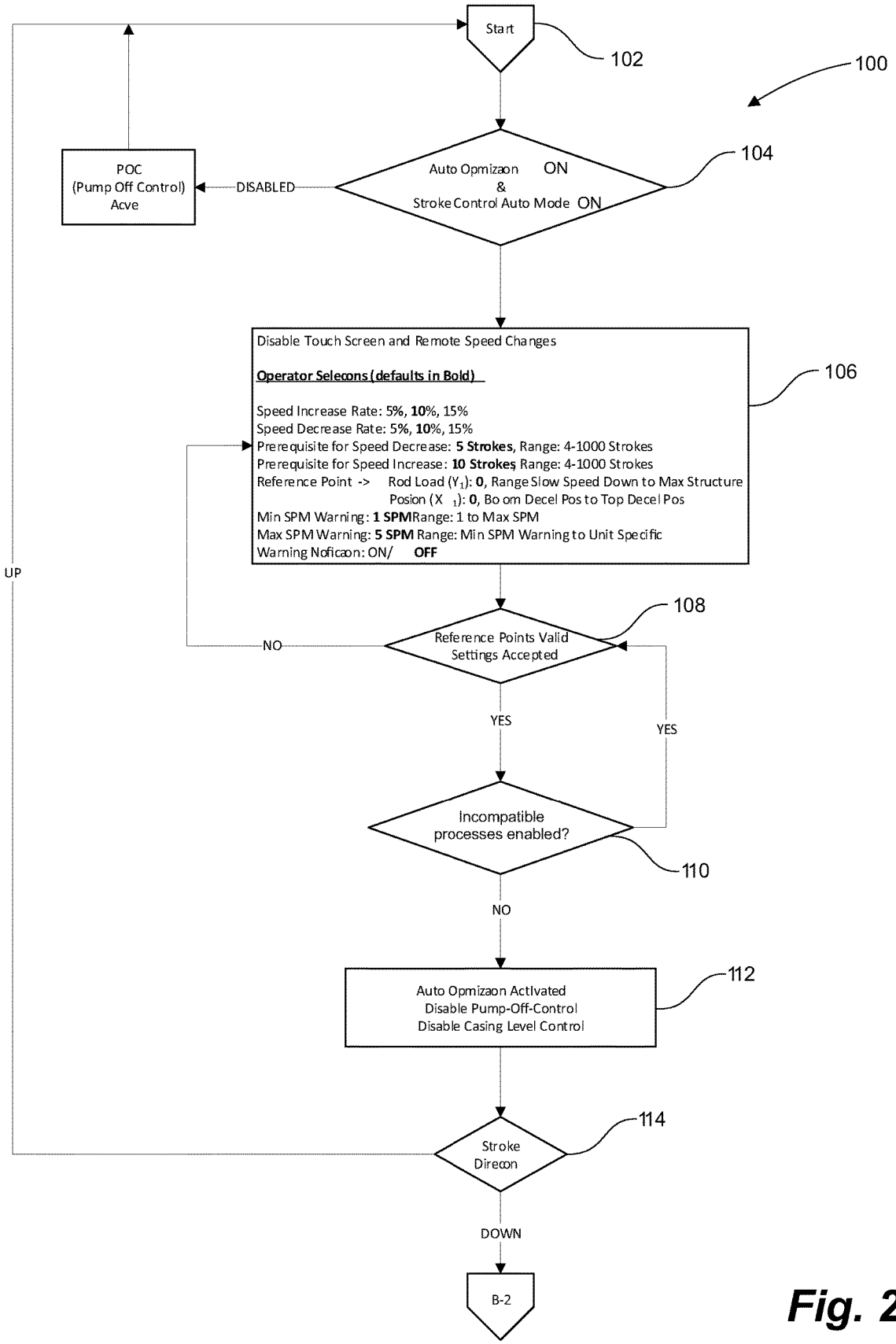
FIGS. 2A and 2B depict a flow chart of an auto-optimization process directed to optimizing the operation of an artificial lift system.
Figure 3:
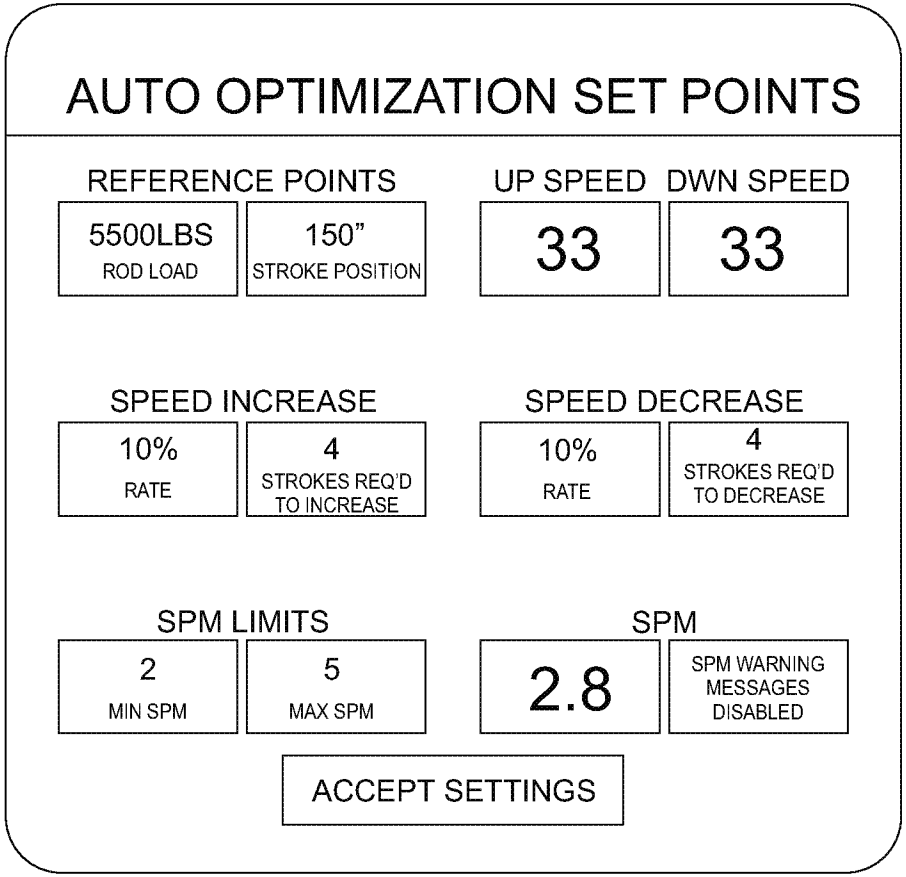
FIG. 3 is a representation of a control panel for monitoring and controlling parameters of the auto-optimization process of FIGS. 2A and 2B.

Returning to FIG. 2A, at step 106, the operator can enter the various optimization parameters of the auto-optimization process 100. At step 108, the process 100 validates the user-defined optimization parameters. The optimization parameters can include, but are not limited to, speed rate increase and decrease increments, stabilization period i.e. the number of strokes N required to be completed between each speed rate increase or decrease, minimum/maximum pump speed rate, target reference points, and warnings/alarms, described in further detail below. By way of example, FIG. 3 shows a picture of GUI screen displayed on control panel 54 that the user of the present system 10 may use to view and select parameters for the present auto-optimization process 100. In the present embodiment, the upstroke and downstroke speed rates of the piston 32 are also shown on the GUI to illustrate to the user how changes to the optimization parameters above affect said speeds of the piston 32. In the present auto-optimization process 100, the upstroke and downstroke speed rates are not manually adjusted by the user, but are instead variables dependent on the auto-optimization process and the user-defined auto-optimization parameters. Said speed rates are displayed on the control panel 54 such that the user can determine whether they are increasing or decreasing as the present auto-optimization process 100 runs. In the present example, the upstroke and downstroke speeds are both initially displayed as 33 strokes per minute (SPM), although it should be appreciated that the upstroke and downstroke speeds of the piston 32 need not be the same.

Returning to the validation of user-defined parameters at step 108 of FIG. 2A, the user-defined auto-optimization parameters of speed rate increase and decrease increments, stabilization period i.e. the number of strokes N required to be completed between each speed rate increase or decrease, minimum/maximum pump speed rates, and target reference points are described below.

Speed rate increase/decrease increments—The speed rate increase and decrease increments are the increments in which the auto-optimization process increases or decreases the stroke rate of the piston 32 in response to measured performance parameters of the system 10. In embodiments, such speed change increments can be displayed as percentages of the present reciprocation speed rate of the piston 32. In some embodiments, the speed increase increment may be set to any number between an allowable range, for example between 1% and 15%, wherein a default speed increase increment of 10% may be pre-selected. In some embodiments, the speed decrease rate may be set to any number between an allowable range, for example between 1% and 15%, wherein a default speed decrease increment of 10% may be pre-selected. In the present example, as shown in FIG. 3, the speed increase and decrease increments are displayed on the GUI as 10%, although it should be appreciated that the increase and decrease increments need not be the same.

Stabilization period—The stabilization period comprises the required number of pump stroke cycles to be completed after an adjustment has been made to the pump speed rate by the auto-optimization process 1000 before a further change in the speed rate can be affected. In embodiments, the stabilization period can be required to be greater than a minimum number of strokes, as described in further detail below. In embodiments, the stabilization period can be required to fall between a minimum and maximum number of strokes.

The use of a stabilization period is desirable as the piston 32 may initially overshoot a target top and bottom position immediately after the pump speed rate is increased, but then stabilize over time to consistently reciprocate between the target top and bottom positions. Such initial overshoot may result in the piston 32 travelling beyond the user-selected top or bottom operational limits but then stabilizing to a target top and bottom position within the operational limits once the Stroke Control Mode has optimized the stroke length. Further stroke speed increases implemented before the stroke length of the piston 32 has stabilized can result in overcompensation by the system 10 such that the actual top and bottom positions of the piston 32 consistently exceed the top or bottom operational limits. Therefore, it is desirable to require a stabilization period to have elapsed to prevent the controller 52 from applying any further changes to the pump speed rate until the stroke length has stabilized after a change in pump speed. In the present embodiment, to account for the initial overshoot following a change in stroke speed, the controller 52 can require a stabilization period, for example a minimum of four (4) strokes, to permit the stroke length to stabilize before further changes are made to the stroke speed. In some embodiments, the stabilization period following a speed rate increase can be any number of strokes within an allowable range, for example between four (4) strokes to one thousand (1000) strokes, wherein a default stabilization period of five (5) strokes or another suitable period may be selected. It is preferable to require a higher number of strokes following a speed increase to provide sufficient time for the movement of the piston 32 to stabilize, while keeping the stabilization period short enough to permit the system 10 adapt sufficiently quickly to changes in wellbore pumping conditions. In the present example, as shown in FIG. 3, the prerequisite number of strokes that must be completed following a speed increase is displayed on the GUI as four (4) strokes, in other words, the system will require the piston 32 to complete four stroke cycles before increasing the pump rate by the selected speed increase rate of 10%.

Conversely, when a speed rate decrease is executed by the controller 52, the piston 32 may not utilize the full allowable stroke length immediately after the pump speed rate is decreased. Such initial undershoot may result in the piston 32 not travelling to the set top or bottom operational limits but then stabilizing to the target top and bottom positions once the Stroke Control Mode has optimized the stroke length. Further stroke speed decreases implemented before the stroke length of the piston 32 has stabilized can result in overcompensation by the system 10 such that the full allowable stroke length of the piston 32 is consistently not utilized. Therefore, it is desirable to prevent the controller 52 from applying any further speed changes until the stroke length is stabilized such that the piston 32 utilizes all of the allowable stroke length. To account for such an undershoot following a decrease in speed rate, in an embodiment, the controller 52 can require a stabilization period, for example a minimum of four (4) strokes, to permit the stroke length to stabilize before further changes are made to the stroke speed. In some embodiments, the stabilization period following a speed rate decrease can be any number of stroke within an allowable range, for example between four (4) strokes up to one thousand (1000) strokes, wherein a default stabilization period of ten (10) strokes or another suitable period may be selected. In the present example, as shown in FIG. 3, the prerequisite number of strokes that must be completed following a speed decrease is also displayed on the GUI as four (4) strokes. It should be appreciated that the prerequisite number of strokes for the speed increase and speed decrease to complete need not be the same, that is, separate stabilization periods can be used for speed increases and speed decreases.

In embodiments, the stabilization period can also be selected to permit the hydraulic fluid reservoir of the surface pumping unit 22 to stabilize after an adjustment to the pump speed rate, in addition to permitting the stroke length to stabilize.

Minimum/maximum pump speed rates—For safety reasons, and to prevent the potential freezing of components of the lift system 10, the operator may set minimum and maximum strokes per minute (SPM) for the pump speed rate, such values being within the design specifications of the system 10 and/or surface pumping unit 22. In the present example, referring still to FIG. 3, the controller 52 can be configured to maintain the pump rate speed between a minimum of 1 SPM and a maximum of 5 SPM. As such, the present auto-optimization procedure 100 will automatically remain within the predetermined minimum and maximum SPM limits, and will not make any speed rate changes that will cause the speed rate exceed those limits. For clarity, once the system 10 has reached the maximum SPM limit of 5 SPM, the system will cease making increases to the SPM. Similarly, once the system has reached the minimum SPM limit of 2 SPM, the system will cease making motor speed changes to further decrease the SPM. In the present example, with reference to FIG. 3, the current SPM of the unit is displayed in real-time on the GUI as 2.8, such SPM thus falling within the minimum and maximum SPM limits. In embodiments, the minimum and maximum SPM limits can be set to any desirable range and can be updated as required.

Target reference points—as mentioned above, the process 100 can also receive target reference points from the user, such reference points representing a desired reference axial rod load at a reference stroke position of the piston 32 or pump 12. At step 108, the controller 52 can review the reference points input by the user to verify they are within an acceptable range. If so, the controller 52 will accept the input reference points. Otherwise, an error message can be displayed to the user, for example on control panel 54, requesting the user to input valid reference points. In an embodiment, an acceptable range for the target reference point can comprise a maximum load equal to or less than the maximum structure load, i.e. the maximum design load of the pumping unit 22, and a minimum load greater than the load at which the controller 52 engages a "slow speed down" process to slow the pump speed in the event of an unexpectedly low rod load. Further, an acceptable range for the piston position of the target reference point can be between the bottom deceleration position and top deceleration position as selected by the Stroke Control Mode.

The target reference points comprise one or more set points representing a reference rod load value at a reference stroke position that is desired to be maintained by the system. For example, a dynamometer card can be produced for a given wellbore as the rod string 20 moves through each stroke cycle, whereby the card plots the load measured on the rod string 20 in relation to the position of the piston 32 or pump 12. As shown by the hatched line in FIG. 4, an ideal dynamometer card charts a rectangular or parallelogram shape, indicative of the fluid load being rapidly picked up and lifted by the pump 12 for the duration of the up-stroke, and then being rapidly released as the pump 12 begins the downstroke. Deviation from the shape of this ideal dynamometer card can indicate inefficiencies in the pumping cycle, such as pump-off and/or fluid pounding.

According to embodiments herein, an operator may determine target reference points, i.e. rod load and piston/position values, that are desired for the system 10 to achieve or outperform in order to avoid pumping inefficiencies such as pump-off and fluid pounding. The target reference points can be entered into the system and the present auto-optimization process 100 will automatically adjust the pump speed rate in order to maintain operation of the lift system 10 within the parameters specified by the target set points, thereby mitigating pumping inefficiencies.

Figure 4:
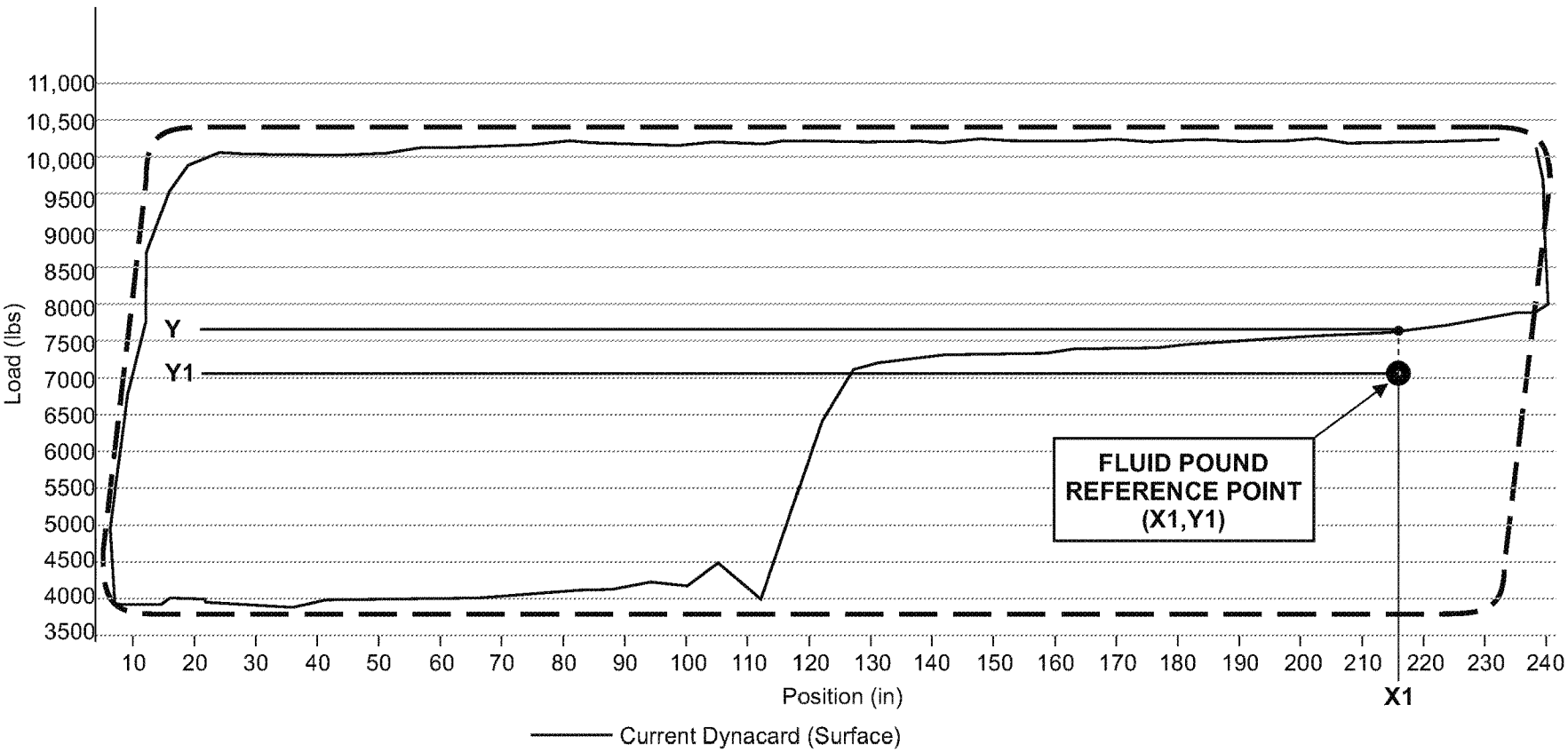
FIG. 4 is a representation of an example dynamometer card and a user-selected fluid pounding reference point for operation of the auto-optimization process.

For example, with reference to FIG. 4, the solid line illustrates a dynamometer card indicative of the presence of fluid pounding in the system 10. One or more fluid pounding target reference points X1,Y1 can be selected and input into the present system. The fluid pounding target reference points can be selected such that a measured rod load Y at or greater than the reference rod load Y1 at reference position X1 can be interpreted to indicate the presence of fluid pounding. In other words, if measured rod load Y at position X1 is above reference rod load Y1, then fluid pounding can be assumed to be present in the system 10. The present auto-optimization process 100 can be configured to automatically adjust the pump speed rate to maintain the measured rod load Y below reference rod load Y1 at reference position X1 to avoid fluid pounding. The use of such reference points in the auto-optimization process 100 is advantageous as the reference points can be quickly updated by the operator if it is found that the previous reference points are no longer accurate in predicting pump inefficiencies, for example due to a change in wellbore conditions. Such updating of reference points can be performed faster than updating a wellbore model as required for conventional processes.

During operation, the present system 10 monitors and compares the actual rod load with the fluid pound reference point by determining the actual load Y at the fluid pound reference position X1 during the downstroke. If, the actual rod load Y is less than the fluid pound reference load Y1 at the fluid pound reference position X1, the pump fillage is sufficient and the controller 52 can either increase the pumping speed rate of the system 10 or not make any changes to the speed rate. If, however, the actual load Y is equal to or greater than the fluid pound reference load Y1 at the fluid pound reference location X1, the controller 52 can conclude that fluid pounding is occurring and automatically adjust to correct the inefficiency, as described in further detail below.

Returning to step 108 of FIG. 2, once the auto-optimization parameters have been reviewed and accepted by the user, and the target reference points are determined by the controller 52 to be valid, the present process 100 can then check as to whether processes incompatible with the auto-optimization process 100 are running. For example, as shown in FIG. 2 at step 110, the controller 52 detects whether any of three processes referred to herein as "high cylinder up pressure", "unit short stroking", and "PID" are enabled, such processed explained in further detail below. If the controller 52 determines that any of these processes are running, the controller 52 can be configured to inhibit further steps of the auto-optimization process 100 and can return to step 108 or another previous step. If the controller 52 determines that none of these processes are running (i.e. systems are OFF), the auto-optimization mode 100 can proceed. Alternatively, the controller 52 can be configured to disable the enabled incompatible processes and proceed to step 112 of the auto-optimization process 100.

High cylinder up pressure refers to methods for detecting pump issues by monitoring hydraulic pressures on the upstroke, for example increases in peak polished-rod load (PPRL). Where it is determined that the hydraulic pressure exceeds an adjustable set point, the artificial lift system 10 will adjust by changing its direction to the downstroke. The controller 52 can be configured to not proceed further with the auto-optimization process 100 until such a condition is remedied. Unit short stroking refers to methods for progressively increasing the stroke length of the unit upon initiation, for example to controllably 'short stroke' the first few strokes of the unit (e.g. a few inches) to allow the system to 'warm up', and then to gradually increase the stroke length to reach operation set points. The controller 52 can be configured to not proceed further with the auto-optimization process 100 until the short stroking is remedied. PID refers to proportional-integral-derivative controller, which is a control loop feedback mechanism that automatically applies correction to a control function. Moreover, the system's casing level control feature, relating to methods for addressing variable or unstable oil levels within the wellbore (i.e. whereby the system limits the unit speed to 1 SPM if the column load is less than an adjustable set point), may also be evaluated. The controller 52 can be configured to not proceed further with the auto-optimization process 100 until the well is no longer in an out-of-balance start up condition.

It is preferable to run the auto-optimization process 100 with the above processes disabled, as said processes can cause speed rate changes that may interfere with the speed changes made by the auto-optimization process 100, and can create or take place in unstable conditions which are not conducive to the comparison of measured rod load and position with the set reference point to determine the need for pump speed changes. For example, "high cylinder up pressure" occurs when load increases due to a problem downhole, Unit Short Stroking occurs during unit start up and after each manual speed change when the system has not stabilized, and PID occurs when there is a loss of load during the downstroke.

Figure 2B:
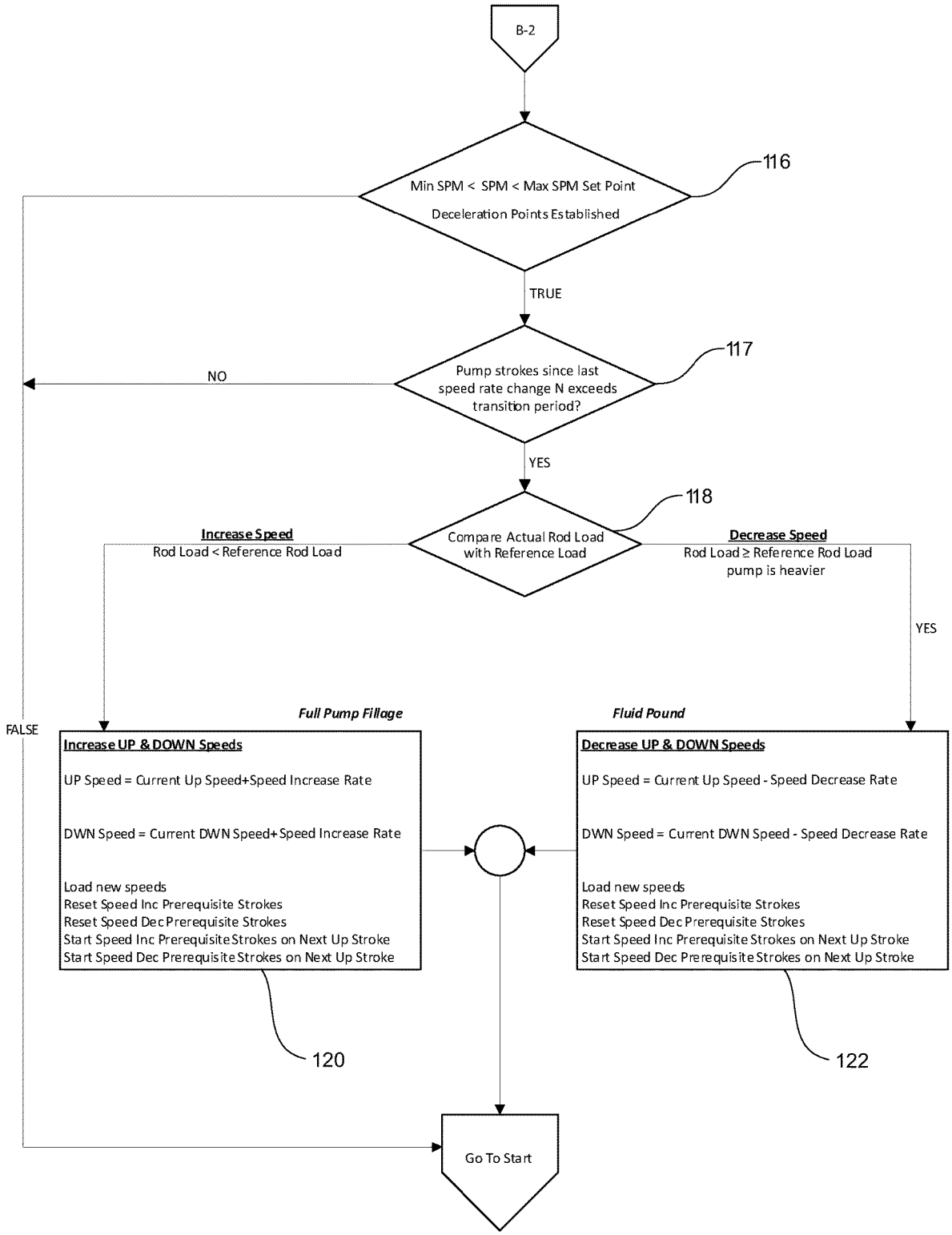

At step 112, the system's 10 pump-off control and casing level control features can be automatically disabled, and the controller 52 begins its auto-optimization evaluation during the next downstroke (B-2; step 114). With reference to FIG. 2B, in embodiments, during the downstroke, the auto-optimization process 100 can determine and confirm that the SPM is within the minimum and maximum SPM (step 116). Moreover, the auto-optimization process 100 can confirm that the top and bottom deceleration points are established per the Stroke Control Mode to ensure that the stroke length remains within the selected top and bottom operational limits. If any of the above requirements are not met, the controller 52 can be configured to not proceed any further with the auto-optimization process 10 and resume its evaluation on the next downstroke, repeating steps 104-114. The controller 52 can further be configured to return an error message or otherwise notify the operator that there is an issue with the operation of the system 10.

At step 117, the process 100 verifies whether the stabilization period has elapsed, i.e. the requisite number of stroke cycles have been completed, since the most recent stroke speed change. If not, then the process 100 can repeat until the required number of stroke cycles have been completed.

If the foregoing requirements are met, the present auto-optimization process 100 proceeds to step 118 to optimize the performance of the lift system 10 by performing a comparison of the measured rod load Y with the target reference rod load Y1 and, based upon the comparison, adjust the upstroke and/or downstroke speeds accordingly if necessary. Utilizing measured rod load values Y and the target reference rod load value Y1 indicative of pump inefficiencies, the present system can adapt, in real-time, to variations in wellbore conditions to maintain optimized production and reduce operational inefficiencies.

For example, if it is determined that the actual rod load value Y is less than the reference rod load value Y1, the pump fillage is sufficient and the system can automatically apply the selected speed rate increase (e.g. 1% to 15%) to the upstroke and/or downstroke to optimize the system's pumping rate (step 120). The new speeds are loaded within the system, and the number of strokes completed since the most recent speed rate change N can be reset for the purposes of ensuring no further speed rate changes are made during the stabilization period. The new speed is applied in the next upstroke, and the controller 52 can wait for the number of stroke cycles required by the transition period to be completed before making another speed change. It should be appreciated that where both the upstroke and downstroke speeds are to be increased, both up and down motor M speeds will increase. By increasing the upstroke and/or downstroke speeds in response to the confirmation that fluid pounding is not occurring as indicated by comparison with the fluid pounding reference point, performance of the artificial lift system 10 is maximized in real-time without dependence on developing updated well models.

Alternatively, at step 122, if it is determined that the actual rod load value Y is greater than, or equal to, the reference rod load value Y1, the system 10 is likely experiencing fluid pounding, and the system will automatically apply the selected speed rate decrease (e.g., 1% to 15%) in upstroke and/or downstroke speeds. The new speeds are loaded within the system, and the number of strokes completed since the most recent speed rate change N can be reset for the purposes of ensuring no further speed rate changes are made during the stabilization period. The new speed is applied in the next upstroke, and the controller 52 waits for the number of strokes required by the transition period to be completed before making another sped change. It should be appreciated that where both the upstroke and downstroke speeds are to be decreased, both up and down motor M speeds will decrease. By decreasing the upstroke and/or downstroke speeds in response to detected fluid pounding as indicated by comparison with the fluid pounding reference point, damage to the artificial lift system is mitigated in real-time without dependence on developing updated well models.

While only one fluid pounding reference point X1,Y1 is set in the above example, in embodiments, multiple fluid pounding reference points can be set to provide greater control over the behaviour of the lift system 10 by the process 100.

In embodiments, other reference points besides fluid pounding reference points can be set to identify other inefficiencies in the operation of the lift system 10, and the process 100 can be adapted to adjust operation of the system 10 in real-time to mitigate the effects of said inefficiencies while maximizing production.

The above auto-optimization process 100 can repeat periodically to continually adjust the pump speed of the system 10. For example, the process 100 can repeat every 10 minutes beginning at step 112 until the auto-optimization mode is disengaged, or an operator changes the parameters of the auto-optimization process 100, at which point the process 100 can continue from step 108.

Under all operating conditions, a local or remote operator has the ability to override the presently described lift system 10 and auto-optimization process 100, returning full control of the system to the operator. Intervention of the operator is enabled by direct or remote interface with the controller 52.

While certain embodiments of the auto-optimization process 100 and system 10 are described herein, alternative processes may be implemented without deviating from the scope of the present invention.

Although embodiments have been described above with reference to the accompanying drawings, those of skill in the art will appreciate that variations and modifications may be made without departing from the scope thereof as defined by the claims.

We claim:

1. A method of optimizing performance of an artificial lift system for producing fluid from a wellbore, comprising:

reciprocating a downhole pump between a lower position and an upper position with a pumping unit;

measuring a position of the pumping unit and an axial load of a rod string of the lift system;

comparing the measured axial load of the rod string at a first reference position with a first threshold axial load at the first reference position;

automatically adjusting a pump speed of the pumping unit according to the measured axial load at the first reference position relative to the first threshold axial load at the first reference position; wherein adjusting the speed of the downhole pump comprises:

if the measured axial load of the rod string at the first reference position is equal to or greater than the first threshold axial load, decreasing the pump speed; and if the measured axial load of the rod string at the first reference position is less than the threshold axial load, increasing the pump speed; and maintaining the pump speed if increasing the pump speed would result in the pumping unit exceeding an upper stroke per minute (spm) operational limit, and maintaining the pump speed if decreasing the pump speed would result in the pumping unit exceeding a lower spm operational limit.

2. The method of claim 1, wherein the pumping unit is configured to decelerate from an upper deceleration point to an upper stroke operational limit, and decelerate from a lower deceleration point to a lower stroke operational limit, and the first reference position is between the upper and lower deceleration points.

3. The method of claim 2, further comprising determining a first drift being the difference between the upper position and the upper operational limit, and a second drift being the lower position and the lower operational limit, and automatically controlling the operation of the pumping unit to minimize the first and second drifts.

4. The method of claim 1, further comprising comparing the measured axial load of the rod string at at least a second reference position with at least a second threshold axial load at the at least second reference position, and automatically adjusting the pump speed according to the measured axial load at the at least second reference position relative to the at least second threshold axial load at the at least second reference position.

5. The method of claim 1, wherein the step of decreasing the pump speed further comprises decreasing the pump speed by a speed decrease interval.

6. The method of claim 5, wherein the decrease interval is between the range of 1% to 15% of the pump speed.

7. The method of claim 1, wherein the step of increasing the pump speed further comprises increasing the pump speed by a speed increase interval.

8. The method of claim 7, wherein the increase interval is between the range of 1% to 15% of the pump speed.

9. The method of claim 1, further comprising maintaining the pump speed above a minimum pump speed and below a maximum pump speed.

10. The method of claim 1, further comprising reciprocating the pumping unit at least for a transition period comprising a minimum number of stroke cycles before adjusting the pump speed.

11. An artificial lift system producing fluid from a wellbore to surface, comprising:

a linear actuator comprising a movable component moveable between a lower position and an upper position and driveably coupled to a downhole pump via a rod string;

a power unit coupled to said linear actuator for driving said movable component to reciprocate; the reciprocating of the movable component driving the downhole rod pump to pump fluid to the surface;

a position sensor for detecting a position of the movable component;

an axial load sensor for detecting an axial load on the rod string; and a controller coupled to the position sensor, the axial load sensor, and the power unit, the controller configured to:

control the power unit for reciprocating said movable component between the lower position and the upper position at a pump speed; and automatically adjust the pump speed in response to the detected position and axial load to avoid fluid pounding by decreasing the pump speed if the measured axial load at a first reference position is equal to or greater than a first threshold axial load at the first reference position, and increasing the pump speed if the measured axial load at the first reference position is less than the first threshold axial load at the first reference position; and maintain the pump speed if increasing the pump speed would result in the actuator exceeding an upper spm operational limit, and maintain the pump speed if decreasing the pump speed would result in the actuator exceeding a lower spm operational limit.

12. The system of claim 11, wherein the controller is further configured to decelerate the actuator from an upper deceleration point to an upper stroke operational limit, and decelerate the actuator from a lower deceleration point to a lower stroke operational limit, and the first reference position is between the upper and lower deceleration points.

13. The system of claim 12, wherein the controller is further configured to compare the axial load at at least a second reference position with at least a second threshold axial load at the at least second reference position, and automatically adjust the pump speed according to the measured force at the at least second reference position relative to the at least second threshold axial load at the at least second reference position.

14. The system of claim 11, wherein the controller is configured to adjust the pump speed by increasing the pump speed by a speed increase increment or decreasing the pump speed by a speed decrease increment.

15. The system of claim 11, wherein the controller is configured to maintain the pump speed above a minimum pump speed and below a maximum pump speed.

16. The system of claim 11, wherein the controller is configured to reciprocate the movable component for a transition period comprising a minimum number of stroke cycles before adjusting the pump speed.

* * * * *